US005673562A

United States Patent [19]

Friedt

[11] Patent Number: 5,673,562

[45] Date of Patent: Oct. 7, 1997

[54] BULK DELIVERY OF ULTRA-HIGH PURITY GASES AT HIGH FLOW RATES

[75] Inventor: Jean-Marie Friedt, San Francisco, Calif.

[73] Assignee: L'Air Liquide, S.A., Paris, Cedex, France

[21] Appl. No.: 606,116

[22] Filed: Feb. 23, 1996

[51] Int. Cl.[6] ..... F17C 7/04

[52] U.S. Cl. ..... 62/48.1

[58] Field of Search ..... 62/48.1

[56] References Cited

U.S. PATENT DOCUMENTS

| | | | |
|---|---|---|---|
| 2,842,942 | 7/1958 | Johnston et al. | 62/48.1 |
| 3,282,305 | 11/1966 | Antolak | 62/48.1 X |
| 3,648,018 | 3/1972 | Cheng et al. | 62/48.1 X |
| 3,827,246 | 8/1974 | Moen et al. | 62/48.1 X |
| 4,219,725 | 8/1980 | Groninger | 62/48.1 X |
| 4,693,252 | 9/1987 | Thoma et al. | 62/48.1 X |
| 5,117,639 | 6/1992 | Take | 62/48.1 X |
| 5,359,787 | 11/1994 | Mostowy, Jr. et al. . | |
| 5,373,701 | 12/1994 | Siefering et al. | 62/48.1 |
| 5,426,944 | 6/1995 | Li et al. . | |
| 5,478,534 | 12/1995 | Louise et al. . | |

FOREIGN PATENT DOCUMENTS

| | | | |
|---|---|---|---|
| 2542421 | 9/1984 | France | 62/48.1 |

OTHER PUBLICATIONS

*Design and Operation of UHP Low Pressure and Reactive Gas Delivery Systems*, S.M. Fine, M.A. George, J.T. McGuire, Semiconductor International, Oct. 1995, pp. 138–146.

*Developing a Bulk Distribution System for High–Purity Hydrogen Chloride*, N. Chowdhury, L. Mostowy, Micro, Sep. 1995, pp. 33–37.

*Joule–Thomson Expansion and Corrosion in HCl Systems*, P. Bhadha, E. Greene, Solid State Technology, Jul. 1992, pp. S3–S7.

*Optimizing the UHP Gas Distribution System for a Plasma Etch Tool*, S. Fine, J. McGuire, B–S. Choi, T. Bzik, K. Crofton, A. Melnyk, M. Perez, D. Sheriff, Solid State Technology, Mar. 1996, pp. 71–81.

*Using Organosilanes to Inhibit Adsorption in Gas Delivery System*, S. Fine, A. Johnson, J. Langan, B–S. Choi, J. McGuire, Solid State Technology, Apr. 1996, pp. 93–97.

*Primary Examiner*—Christopher Kilner

[57] ABSTRACT

In accordance with the present invention, methods and systems are provided which afford solutions to the problems of gas distribution of ultra-high purity ESGs at high gas flow rates. A first aspect of the invention is a system comprising a compressed liquefied gas container; an internal heat exchanger within the compressed liquefied gas container; a gas supply conduit which takes feed from the container and delivers the ESG to a process; and an external heat exchanger positioned effectively near the conduit downstream of the container but upstream of the process.

12 Claims, 2 Drawing Sheets

BULK DELIVERY OF ULTRA-HIGH PURITY GASES AT HIGH FLOW RATES

BACKGROUND OF THE INVENTION

1. Field of the Invention

This invention pertains generally to methods and systems for delivery of ultra-high purity for some electronic specialty gases, particularly at high or highly varying flow rates.

2. Related Art

Ultra-high purity electronics specialty gases (ESGs) are needed for the manufacture of integrated circuit devices.

Currently, ultra high purity is defined in terms of impurity concentrations of less than 100 ppb (part per billion) for any volatile molecules, specially $H_2O$; particulate concentration of size larger than 0.3 micrometer at less than 1/liter of gas under normal conditions; and metallic impurities at less than 1 ppb (parts per billion in atomic units) per element. In the conventional technology of ESG packaging in compressed gas cylinders, such results are usually reached using special care. In particular, use of selected materials and surfaces which are very stable against the ESG, and strictly avoiding the presence of superficial moisture on any of these surfaces (which would promote corrosion and hence particulate or metallic contamination). Further, selecting gas flow control components (valves, pressure reducers, flow controllers) free of particulate generation by mechanical friction or by corrosion is good practice, and following careful operating procedures helps to insure the required surface clearness of the whole line. Although seemingly trivial the actual implementation of such a system permitting to deliver at the point of use the above defined ultra high purity ESG is in practice very delicate and involves specialized know-how. For instance, it has been realized recently that some of the impurities, such as $H_2O$ and metal halides, may actually be generated in the system itself, e.g., by reaction between HBr and surface metallic oxides, particularly Mn or Fe oxides, rendering the above precautions ineffective in practical usage.

It is important to realize that for a number of ESG's the principle of evaporation thermodynamics shows that the gas phase in a high pressure gas-liquid phase equilibrium will be highly pure, e.g., less than 1 ppm of $H_2O$ is found in the gas phase of HBr in a high pressure system where gas and liquid phases coexist as shown by Haase et al., J. Physik. Chem., 37, 210 (1963), and confirmed by the assignee herein. (See FIG. 1).

However, a difficulty to take advantage in practice of the phase equilibrium properties arises from the common actual usage conditions, where temperature and pressure of the compressed gas-liquid system changes widely because of high or highly varying gas flow rate withdrawn in practical usage from the compressed gas cylinder. This arises from the fact that under practical conditions of usage the heat of evaporation is frequently not compensated by external heat supply, i.e., the whole compressed gas-liquid system cools down very significantly, hence changing totally, and often unfavorably, the conditions of the gas-liquid phase equilibrium. For larger flow rates, liquid phase ESG can even be entrained by the withdrawn gas flow of ESG.

Additional origin of cooling of the flowing gas is by Joule-Thomson expansion through reduced orifices as encountered in e.g., valves, pressure regulators or other components. Such components introduce pressure and temperature changes, which may induce additional condensation of liquid phase droplets or aerosols from the gas phase.

According to the HBr—$H_2O$ phase diagram, such liquid phase droplets may be highly enriched in $H_2O$ concentration, which will then induce much stronger corrosion when the liquid touches the metallic surfaces, more so than where the gas phase (without such droplets) touches the metallic surfaces. This will induce not only particulate and metallic contamination but also modify the composition of the gas flow via adsorption-desorption phenomena involving the metallic halide compounds formed on the metallic surfaces via the reaction mentioned previously. The problem has been solved partially, for instance by introducing purifiers at the line inlet specifically to remove $H_2O$ from the vapor phase, and by preheating the gas before passage through a reduced size orifice so that ambient temperature is attained at the exit of the reduced orifice. However, the cooling of the compressed gas and the consequent evaporation of an aerosol containing gas phase and liquid phase droplets cannot be fully avoided by the above techniques, especially in the vicinity of the cylinder outlet valve and other control devices and at high flow rates of gas withdrawal from the liquefied compressed gas container.

The liquid phase droplets evaporated from the gas-liquid interface are metastable, but actually are present for a long life time, and are difficult to convert effectively into vapor phase within the gas distribution network. They may thus affect a large portion of a gas distribution network since they are highly corrosive against the metallic surfaces when deposited thereupon, much more so than the gaseous phase of the same ESG.

In summary, it would be advantageous if a method and system were available which would:

- Insure the withdrawal at much higher gas flow rate than usual (e.g., 100–500 standard liters per minute (slm) for gases like HBr, HCl, $Cl_2$, $NH_3$, $BCl_3$) of a substantially constant composition gas flow from a compressed liquefied gas container;
- Suppress generation of the metastable compressed gas aerosol generated from the compressed liquid-gas interface; and
- Compensate for the cooling phenomena due to Joule-Thomson expansion, thus avoiding liquid droplet formation in the gas phase and the unfavorable consequences within the whole gas distribution system.

SUMMARY OF THE INVENTION

In accordance with the present invention, methods and systems are provided which afford solutions to the above problems of gas distribution of ultra-high purity ESGs at high gas flow rates. A first aspect of the invention is a system comprising a compressed liquefied gas container; an internal heat exchanger within the compressed liquefied gas container; a gas supply conduit which takes feed gas from the container and delivers the ESG to a process, the conduit having therein flow control and pressure reduction components; and an external heat exchanger positioned effectively near the conduit downstream of the container but upstream of the flow control and pressure reduction components in the supply conduit.

The internal heat exchanger functions to maintain the temperature of the liquid-gas interface inside the container essentially constant, while the external heat exchanger functions primarily to preheat the gas before any reduced orifice in order to prevent formation of liquid phase in the flowing gas phase and secondarily to volatilize effectively any metastable droplets which may be entrained by gas flowing at high flow rate from the container. Power for the internal heat exchanger is preferably computer-controlled according to the actual flow rate of the gas desired by the user of the system. A flow measurement means is provided in the gas supply conduit and the heating power is adjusted empirically based on the calculation of the energy of vaporization of the liquid in the container. The effectiveness of the procedure is controlled by the measurement of the pressure within the vessel, which must be essentially constant. The container preferably has a shape conducive for the pressures required to maintain the chemical as a liquid. Preferably, the container is a welded, cylindrical vessel, designed in consideration of a maximal area for the Liquid-gas interface and of other technological aspects.

Pre-heating the gas prior to any orifice or other flow restriction or pressure reducing component in the gas supply conduit is preferred. Also preferred is thermal regulation of the whole gas supply conduit such as to avoid any spot reaching a temperature lower than the temperature of the compressed liquid-gas interface.

All materials exposed to the ESG in the system of the invention are selected such that the ESG is substantially inert to these surfaces. Further, surface cleaning and drying procedures are practiced before exposing these surfaces to the ESG, in particular in order to avoid any trace of moisture absorbed and/or adsorbed on the internal metallic surfaces of the system as might be induced by intrusion of ambient air into the system.

The inventive system and method permit high flow rate supply of ultra high purity ESG's, such as 100–500 slm of HBr, HCl, $NH_3$, or $Cl_2$. The same principles apply to other ESG's ($SiH_2Cl_2$, $WF_6$, $BCl_3$) in different thermal and flow-rate regimes.

DESCRIPTION OF PREFERRED EMBODIMENTS

Figure 1:
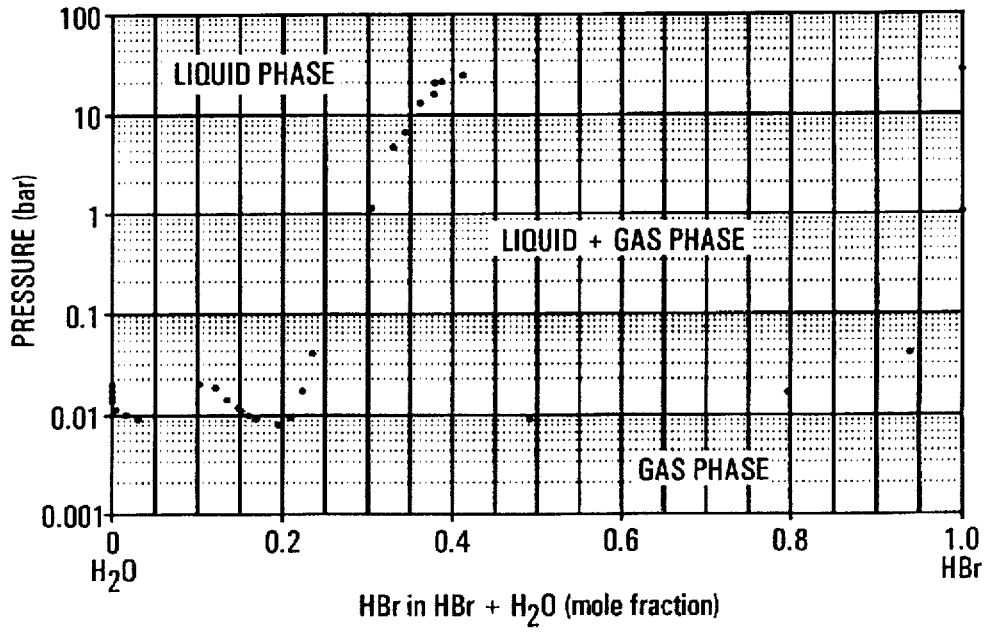
FIG. 1 is a phase diagram of the HBr—$H_2O$ system.

The pressurized liquefied ESG is transferred and stored at the point of usage into a container which is a high pressure vessel made of a material which is strictly non-reactive with the ESG, e.g., types 304 and 316 stainless steel or Hastelloy or nickel or a coated metal, e.g., a zirconium-coated carbon steel vessel. Prior to introduction of the ESG into the container, the container is preferably purged one or more times by alternating vacuum-high pressure, high purity inert gas cycles, with the whole container preferably heated at a temperature ranging from about 80°–120° C. using the installed heater. The container thus needs to withstand both vacuum and pressures of up to 100 bar. Typical operating pressures for the container range from about 2 to about 100 bar, more preferably from 6 to 60 bar.

The ESG is preferably transfilled into the container under high pressure from a mother tank, using either gaseous or liquid phase flow. This transfilling affords another measure of purification of the ESG, as dirt and particulate matter tend to be left in the mother tank. The transfer is preferably assisted by cooling the container at cryogenic temperature using, if necessary, the external and/or internal heat exchanger(s). The container is preferably installed "on-site", that is, in close proximity to where the ESG will be used in a building designed for the safe handling of the ESG. In particular, the building is preferably equipped with automatic gas sensors and an emergency abatement system for the case of occurrence of an accidental leakage.

The container is connected to the point of usage of the ESG through a conduit system using one or several pressure reducers, valves, pressure sensors and flow meters positioned as desired in the gas supply conduit. All of these are preferably constructed from materials unreactive with the ESG, using materials previously mentioned as suitable for the container.

The whole conduit network is equipped with an external heat exchanger designed to control the network temperature just above the temperature of the gas-liquid interface, preferably at least 5° C. difference. Before exposing the conduit network to the ESG, the conduit network is carefully purged by a high purity inert gas (for example ppb purity nitrogen) with the whole conduit network heated at a temperature varying from about 80° to 120° C. In order to take full advantage of the liquid-gas phase purification features predicted by the phase diagram equilibrium thermodynamics even at high gas flow rates (defined herein as about 100–500 slm), the liquid-gas interface is maintained at essentially ambient temperature (about 20°–25° C.) by installing an internal heat exchanger, preferably at the top of the container, and heating the interface by both radiative energy transfer and thermal conductivity through the gas phase within the container. The thermal energy is preferably computer controlled to compensate for the energy of vaporization (evaporative cooling) according to the used flow rate of gas from the system.

The pressure within the container is monitored to be essentially constant during the whole period of usage of the pressurized liquefied ESG. Any observed significant change of container pressure is corrected by changing the heating energy either through computer control or manually.

The shape of the vessel is preferably designed to enhance the area of the liquid phase-gas phase interface, such as to optimize the energy transfer from the heat source into the liquid phase. Cylindrical (vertical and horizontal), as well as spherical containers are desired.

Moreover, for the case of non-equilibrium entrainment of liquid droplets by the large evaporated gas flow, the heat exchanger is designed in such a way as to volatilize all droplets before they would otherwise exit the container.

The source of heat for the heat exchangers is insured either by a liquid heat transfer media circulating in a metallic coil, or by electrical heating using a heater embedded in a metallic coil such as, e.g., that known under the trade designation THERMOCOAX. In either case, the metallic coiling is made of a corrosion resistant alloy such as stainless steel, Hastelloy, nickel or the best selected alloy for the specific ESG considered. In the case where a liquid provides the energy, the liquid heat transfer medium is selected not only for its thermal properties but also for safety issues in the case of an accidental leakage, for its chemical stability against the specific ESG under consideration, for example, liquid glycols or silicon oils. The choice of liquid heat transfer medium ultimately depends on the specific ESG to be handled.

The temperature of the whole ESG distribution system of the invention is thermally regulated in such a way that no portion of it reaches a temperature lower than the temperature of the gas-liquid interface in the pressurized ESG container, in other words, the ambient temperature (about 25°) of the container. This involves in particular providing excess thermal energy prior to any gas expansion in the system through any reduced size orifice or other pressure drop-inducing component. In practice, depending on the desired gas flow rate and on the specific ESG to be handled, the container pressure is preferably reduced to the desired usage pressure in successive steps in order to minimize the cooling effect through a single pressure reducer.

Figure 2:
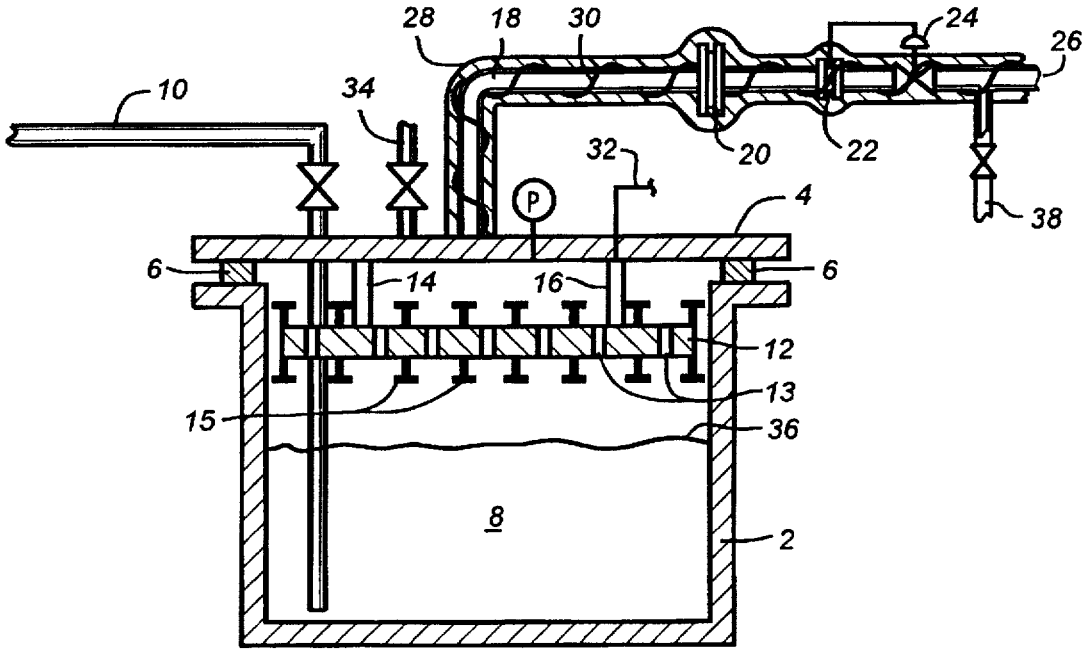
FIG. 2 is a process schematic flow diagram (side elevation, reduced) of a system in accordance with the invention.

Referring now specifically to the figures, FIG. 2 is a schematic cross section diagram of the system of the present invention. A container 2 having a lid 4 which is sealed to the container base by a seal 6 holds an ESG 8, which had previously entered the container through an inlet conduit 10. Seal 6 is a metal or metal coated gasket, composed of nickel or an appropriate corrosion resistant alloy. An internal heat exchanger 12 is advantageously present near the upper portion of container 2 and physically attached to lid 4 via hangers 14 and 16. Vaporized ESG exits container 2 and flows through conduit 18, which has pressure reduction means 20 and 22, as well as a flow control valve 24 therein. The vaporized ESG exits the system at 26, which preferably represents a point of entry to a semiconductor processing tool. Pressure is monitored using a pressure sensing device (P).

Conduit 18 and associated flow components 20, 22 and 24 are typically insulated using commonly known insulation 28, for example, glass wool insulation and the like. In close proximity to conduit 18 and components 20, 22 and 24 is an external heat exchanger 30. External heat exchanger 30 may either be a metallic coil through which a liquid heat transfer media passes, or an electrical heating element embedded in a metallic coil, such as discussed earlier.

Internal heat exchanger 12 is provided with a source of energy 32, which may either be an electrical current, or another temperature controlled heat transfer media as described above. It is preferred that internal heat exchanger 12 have a shape that is advantageous for the particular container shape so that the gas-liquid interface 36 is easily maintained at a constant temperature, depending on the ESG being dispensed. Heat exchanger 12 has a plurality of through holes 13, which allow the vaporized ESG to flow out of container 2. Heat exchanger 12 also preferably has fins 15 or other surfaces which enhance heat transfer. It is also preferred that heat source 32 be connected to computer means (not illustrated), wherein gas liquid interface 36 is held at a constant temperature. This is preferably accomplished by calculating the heat input necessary to internal heat exchanger 12 empirically by sensing the flow rate of the ESG through conduit 18 and using a proportionality constant to calculate how much heat input is necessary to compensate for the heat of the evaporation to produce the measured flow rate of ESG. The monitoring of the vessel internal pressure is used as a secondary regulation measurement.

A pressure relief valve 34 is also included in the system to prevent over pressuring of the system and catastrophic failure of the system. Also included in the systems of the present invention is preferably a ESG sampling point 38. Samples of the ESG may be collected at point 38 and either analyzed on site for impurities (metals, water vapor and the like), or the sample may be taken to an off-site analysis laboratory, for example through the use of a portable gas sampling apparatus such as disclosed in U.S. Ser. No. 08/609,836, filed Mar. 1, 1996, which issued as U.S. Pat. No. 5,618,996 on Apr. 8, 1997. This connection and others like it may be used to fill the system with inert gas and purge the system, as is known in the art, such techniques not a part of the invention.

Figure 3:
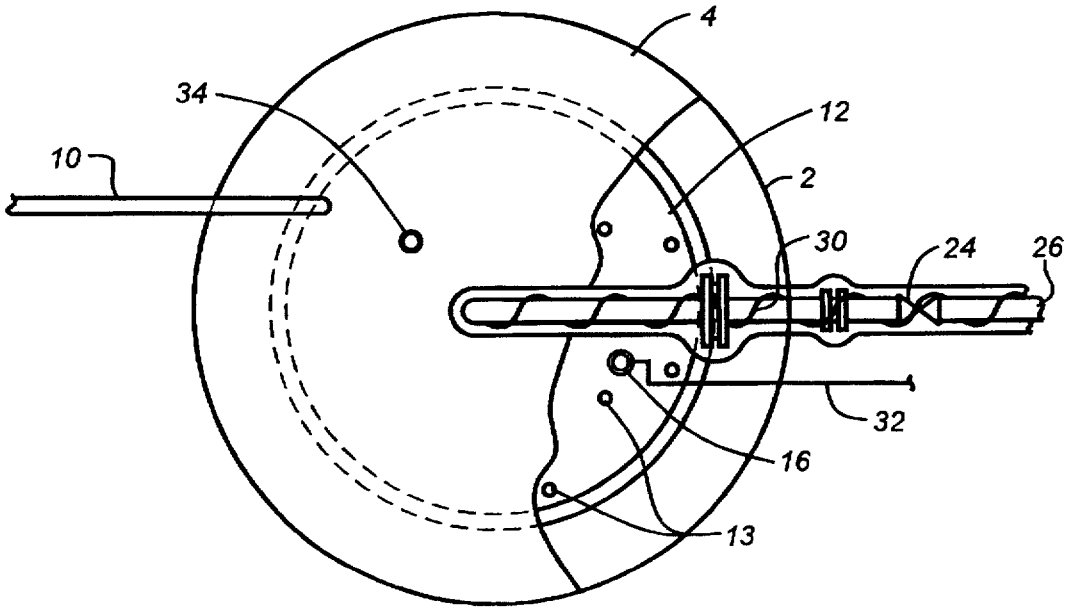
FIG. 3 is a plan view, with portion cut away, of the system of FIG. 2.

FIG. 3 is a plan view, with parts partially cut away, of the system illustrated in FIG. 2. In FIG. 3 it may be clearly noted that the peripheral shape of internal heat exchanger 12 closely follows the internal shape of container 2. That is, the periphery of internal heat exchanger 12 is always in close proximity to the internal side of container 2.

The above described inventive methods and systems permit the delivery (preferably continuous) at the point of use of an ultra-high purity ESG at high or highly varying flow rates, as defined herein, and to maintain the integrity in terms of corrosion and trouble-free continuous operation of the whole distribution system. This is desirable not only in terms of control of ESG microcontamination but also of the avoidance of corrosion and its undesirable consequences regarding safety and the smooth operation of the whole system.

If preferred, purifiers and filters can be included in the inventive distribution systems for full quality insurance, but these are not required if the above described procedures are strictly implemented.

In conclusion, high flow rates (100–500 slm) of ultra-high purity ESG, for example, HCl, HBr, $Cl_2$, from a high pressure liquefied gas container, by using a bulk delivery system of the pressurized liquid ESG is described. This is accomplished by exploiting the purification of the gas phase in comparison to the pressurized liquid phase by first maintaining the gas-liquid interface at a constant temperature (ambient temperature) through use of an internal heat exchanger in order to compensate for the evaporative cooling of the liquid as it forms the gas. Second, any metastable aerosol which may be formed due to such high gas flow rate is reduced or eliminated by flowing the gas through a temperature controlled conduit, by use of an external heat exchanger.

The ultra-high purity gaseous ESG is transported to the point of usage without purity degradation by regulating the temperature of the whole distribution system in such a way that the whole system (conduits, valves, and the like) is always maintained at a temperature higher than the temperature of the temperature of the pressurized gas container. Excess thermal energy is provided prior to any expansion of the gas, as may occur by the gas flowing through pressure reducers, valves or other system components. This prevents undesirable cooling and ultimately formation of liquid phase in the gas phase while the latter flows within the distribution system and hence prevents corrosion phenomena, especially corrosion prompted by liquid droplet deposition. This in turn increases safety and improves the productivity of the manufacturing process.

For the proper and safe operation of the inventive system, the pressurized container and all conduits, valves, orifices, and the like are preferably constructed from highly corrosion resistant alloys such as stainless steel, Hastelloy, nickel, and the like. In order to avoid parasitic corrosion, it is highly preferred to remove from the surface of these alloys any adsorbed moisture by initial subjection to high temperature (about 80°–120° C.), using high purity inert gas purging, prior to and after any exposure to the ESL and ESG's.

In addition to the above described trouble free operation of high flow rate—ultra high purity delivery of ESG's at the point of use, the usage of large volume supply has the advantage of reducing the frequency of container disconnection and reconnections, which are well known to be the critical operations frequently responsible for secondary contaminations and failures or malfunctions.

The same principles are applicable to other ESG's by scaling through appropriate thermal and flow rate regimes.

The invention is further described with reference to the following examples, wherein all parts and percentages are by weight unless otherwise specified.

EXAMPLE

The above technology has been demonstrated on several gases, but HBr is given as one example.

Experiments using HBr in the range of gas flow rates between 10 and 150 l/min are described hereafter.

The container is installed at the point of usage and conduit transfer conduit between this container and the bulk source container (mother tank) are both carefully purged by repeated vacuum-pressure cycles using ultra-high purity inert gas (ppb purity nitrogen) with all the metallic parts heated at 80° to 120° C.

The container is next cooled to about −195° C. using liquid nitrogen, and electronic grade liquefied HBr is allowed to flow into the thus cooled container from a bulk source of HBr kept at ambient temperature, e.g., large size cylinders under 35 bar pressure. The excess HBr gas which is not trapped in the containers is destroyed in an appropriate scrubbing device.

The valves equipping the container are closed and the container is then brought to room temperature, resulting in a container pressure of approximately 25 bar.

The whole conduit between the container exit valve and the point of use is vacuum-pressure cycle purged with the lines heated to 80°–120° C., similar to the above description for the transfilling procedure.

Next, gas is flown from the container to the point of usage under approximately constant pressure of about 20 bar maintained in the container by regulated heating of the heat exchanger located at the upper port of the container.

Using such a system of delivery between 10 and 150 l HBr gas per minute, allows to provide an ultra-high purity of the gas delivered at the point of usage in terms of $H_2O$ concentration, particulate concentration and metallic impurity concentration for the whole duration of the gas flow, except for the initial few minutes of the gas supply. Also, the quantity of consumed HBr is monitored closely in order to avoid the container being totally depleted in liquid phase, since it is known, and has been observed again here, that the impurity concentrations rise sharply when the gas is consumed up to the disappearance of the liquid phase in the pressurized container.

Before the container is fully emptied in liquid phase, the flow is stopped and supply is switched to a second identical container.

The used container is totally emptied through the scrubbing device and then again carefully purged at high temperature through repeated vacuum-pressure cycles. After insuring the total purging of the system, it is opened for wet cleaning and replacement of the sealing components.

By following strictly the above procedures, especially the strict purging of any metallic surface before and after exposure to the open air, corrosion of the whole line and container is essentially prevented and in turn the undesirable consequences in terms of contamination of the distributed gas.

The whole technology hence allows a long term trouble free delivery of ultra-high purity ESG's at high flow rates. Of further advantage is the reduction of the number of container exchange connections and consequent risks of exposure to ambient atmosphere, which are known to be a major reason for the common failures in conventional cylinder ESG distribution.

Figure 4:
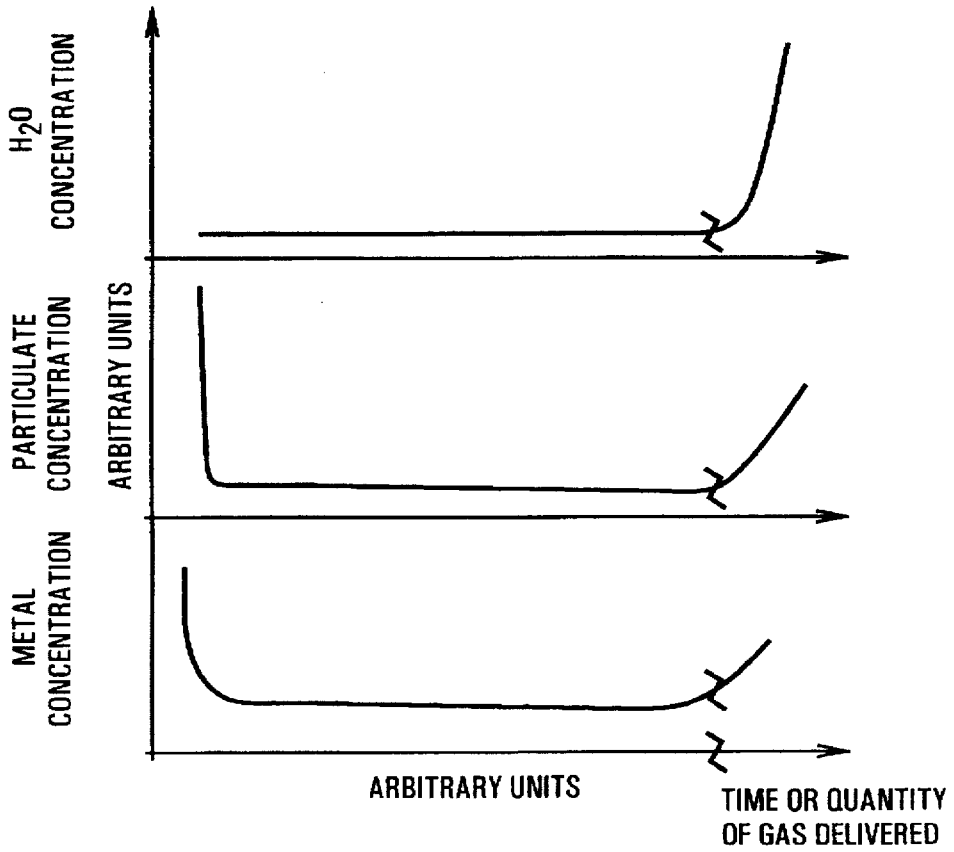
FIG. 4 is a graphical representation of typical impurities in ESGs as a function of time of delivery, or quantity delivered.

Schematic representation of the impurity concentrations in HBr gas delivered from a bulk pressurized liquefied HBr container as a function of the quantity of delivered gas is shown in FIG. 4.

Further modifications of the invention will be envisioned by those having skill in the art, and those modifications are deemed to be within the appended claims. The claims are not intended to be limited to the specifically described embodiments.

What is claimed is:

1. A system for delivery of an ultra-high purity gas from a liquid form, the gas being supplied at high or highly varying flow rate, the system comprising:

a container including an interior space for a compressed liquefied gas, said interior space including an internal shape;

an internal heat exchanger within the container, said internal heat exchanger having a peripheral shape which closely follows said interior space internal shape;

a gas supply conduit in fluid communication with said interior space of the container; and an external heat exchanger positioned in the vicinity of the container and gas supply conduit, said internal and external heat exchangers preventing entrained liquid droplets from entering or forming in said gas supply conduit.

2. System in accordance with claim 1 wherein the gases delivered are selected from the group consisting of HCl, HBr, $Cl_2$, $NH_3$, and gases whose phase diagram allows one to predict a purification in critical impurities between gaseous and liquefied phases of the gas.

3. System in accordance with claim 1 wherein the internal heat exchanger is positioned near the top of the container.

4. System in accordance with claim 1 wherein the container has a shape selected from the group consisting of cylindrical and spherical.

5. System in accordance with claim 3 wherein the external heat exchanger is adapted to maintain the gas supply conduit at a temperature higher than a temperature of the container.

6. System in accordance with claim 5 wherein said external heat exchanger is adapted to maintain said gas supply conduit at a temperature at least 5° C. higher in all locations than the temperature of the container.

7. System in accordance with claim 1 wherein the gas supply conduit has therein at least one pressure reducing means.

8. System in accordance with claim 1 wherein all components of the system in contact with the liquid and gas are made of materials selected from the group consisting of stainless steel, Hastalloy, nickel, and combinations thereof.

9. System in accordance with claim 1 wherein the internal heat exchanger is adapted to be computer controlled to compensate for the energy of vaporization according to the flow rate of gas from the system.

10. A method of supplying a gas at high purity and high flow rate to a semiconductor manufacturing site using the system of claim 1, said method comprising the steps of:

a) purging the container and gas supply conduit using one or more alternating vacuum-high pressure, high purity inert gas cycles;

b) transfilling the container with the desired chemical from a mother tank using either gaseous or liquid flow while maintaining the pressure of the container sufficient to have a gas-liquid interface;

c) maintaining the liquid-gas interface at approximately ambient temperature and allowing the gas to escape from the container through said gas supply conduit; and d) heating the escaping gas using said external heat exchanger, thus substantially reducing the presence of non-equilibrium entrained liquid droplets of the chemical.

11. Method in accordance with claim 10 wherein during steps (c) and (d) said conduit is maintained at a temperature above a temperature of said container.

12. Method in accordance with claim 10, wherein said high flow rate is at least about 100 standard liters per minute.

* * * * *